US007972665B2

(12) United States Patent
Ogata et al.

(10) Patent No.: US 7,972,665 B2
(45) Date of Patent: Jul. 5, 2011

(54) INK JET RECORDING MEDIUM

(75) Inventors: Yasuhiro Ogata, Shizuoka (JP); Fuyuhiko Mori, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 1126 days.

(21) Appl. No.: 11/664,612

(22) PCT Filed: Sep. 29, 2005

(86) PCT No.: PCT/JP2005/018491

§ 371 (c)(1),
(2), (4) Date: Apr. 4, 2007

(87) PCT Pub. No.: WO2006/038666

PCT Pub. Date: Apr. 13, 2006

(65) Prior Publication Data

US 2008/0075898 A1 Mar. 27, 2008

(30) Foreign Application Priority Data

Oct. 4, 2004 (JP) ..... 2004-291508

(51) Int. Cl.
*B41M 5/40* (2006.01)

(52) U.S. Cl. ..... 428/32.18; 428/32.19; 428/32.27; 428/32.28; 428/32.31; 428/32.33; 428/32.34

(58) Field of Classification Search ..... 428/32.18, 428/32.19, 32.27, 32.28, 32.31, 32.33, 32.34
See application file for complete search history.

(56) References Cited

U.S. PATENT DOCUMENTS

| | | | | |
|---|---|---|---|---|
| 2002/0025413 | A1* | 2/2002 | Ohbayashi et al. | 428/195 |
| 2003/0198885 | A1 | 10/2003 | Tamagawa et al. | |
| 2004/0096599 | A1 | 5/2004 | Kobayashi et al. | |
| 2009/0022910 | A1* | 1/2009 | Teramae | 428/32.2 |

FOREIGN PATENT DOCUMENTS

| | | | |
|---|---|---|---|
| EP | 0 770 493 | A | 5/1997 |
| EP | 1 114 733 | A | 7/2001 |
| JP | 9-254526 | A | 9/1997 |
| JP | 10-119423 | A | 5/1998 |
| JP | 10-217601 | A | 8/1998 |
| JP | 2000-233564 | A | 8/2000 |
| JP | 2000-355160 | A | 12/2000 |
| JP | 2001-341409 | A | 12/2001 |
| JP | 2001-347748 | A | 12/2001 |
| JP | 2001-347753 | A | 12/2001 |
| JP | 2003-80831 | A | 3/2003 |
| JP | 2003-191591 | A | 7/2003 |
| JP | 2003-326838 | A | 11/2003 |
| JP | 2004-160916 | A | 6/2004 |
| JP | 2004-243555 | A | 9/2004 |

OTHER PUBLICATIONS

European Search Report dated Dec. 9, 2008.

* cited by examiner

*Primary Examiner* — Betelhem Shewareged
(74) *Attorney, Agent, or Firm* — Sughrue Mion, PLLC

(57) ABSTRACT

The invention provides an ink jet recording medium comprising a support and an ink receiving layer provided on at least one surface of the support. In one embodiment, a center line average roughness average Ra of a surface of the ink-receiving layer, measured with a 2.5 mm measuring length and 0.8 mm cut-off value, is in a range of 0.3 μm or more but less than 0.8 μm. In another embodiment, a center line average roughness average Ra of the surface of the support measured with a 2.5 mm measuring length and 0.8 mm cut-off value, is preferably in a range of 0.3 μm or more but less than 1.0 μm. An image clarity of the surface of the ink receiving layer is preferably in a range of 2 to 40%.

10 Claims, No Drawings

INK JET RECORDING MEDIUM

BACKGROUND OF THE INVENTION

1. Field of the Invention

The invention relates to a high-quality ink jet recording medium. Specifically, the invention relates to an ink jet recording medium that provides a ink jet print having a sharpness and a sense of depth and is excellent in recordings of images of people or the like.

2. Description of the Related Art

Recently, various information processing systems have been developed along with rapid development in the information industry. Recording methods and devices suitable for these information processing systems have also been developed and variously put to practical use.

Examples of practically used recording methods include, in addition to silver salt photographic methods, electrophotographic methods, ink jet recording methods, thermal recording methods, sublimation transfer methods and thermal transfer methods. The requirement to obtain sharp and vividly hued high-resolution images is the same in any of the above-mentioned recording methods.

Among the above-mentioned recording methods, the ink jet recording method can be used to record on many kinds of recording materials, and hardware (a device) therefor is comparatively low-priced, compact, and very quiet. Therefore, the ink jet recording method has been widely used in the office as well as at home.

Further, various mediums for ink jet recording have been developed in recent years along with the achievement of high resolution ink jet printers and the development of hardware (devices), and it has become possible to obtain so-called "photograph-like" high-quality recorded products.

In particular, examples of the properties required for the mediums for ink jet recording include (1) quick drying (high ink absorption speed), (2) ink dots having proper and uniform diameters (no bleeding), (3) excellent granularity, (4) high circularity of dots, (5) high color density, (6) high saturation (no dullness), (7) excellent light fastness, gas resistance and water resistance at printed portions, (8) a recording surface having a high degree of whiteness, (9) excellent storability of a recording medium (no yellow discoloration or image bleeding during long term storage), (10) resistance to deformation and excellent dimensional stability (sufficiently small curl), and (11) excellent running properties in hardware. Further, in addition to the above-mentioned properties, glossiness, surface flatness and texture similar to that of a silver salt photograph are required for use as photographic glossy paper used to obtain the photograph-like high-quality recorded product.

A specific example is an ink jet recording sheet containing fine inorganic pigment particles and a water soluble resin, wherein the recording sheet has a porous coloring material receiving layer with a high void ratio is provided on a support (for example, see Japanese Patent Application Laid-Open (JP-A) Nos. 10-119423 and 10-217601). These sheets, in particular an ink jet recording sheet comprising a coloring material receiving layer composed of a porous structure using silica as the inorganic pigment fine particles is excellent in ink-absorbability due to its structure, while the sheet also has a high ink-receiving performance that enables high resolution images to be formed with high luster.

Although a photograph-like image may be obtained by giving the recording sheet a glossy finish, this glossiness varies with the image shape and the glossiness easily becomes uneven. When such an uneven difference in glossiness of image shapes is generated, glare is generated on the image surface, causing an unnatural print, and the print is not one which provides a sense of high quality. In order to eliminate the differences in glossiness of image shapes, a method has been disclosed which regulates and improves glossiness in which center line average (CLA) roughness average (Ra) of the surface of the ink-receiving layer is increased to 0.8 to 4.0 μm (for example, see Japanese Patent Laid-Open No. 2000-355160). Generally, an improvement in image quality requires not only a sense of glossiness, but also photograph-like stereoscopic expression providing a sense of depth, brilliant vividness, and sharpness providing a sense of clarity.

However, the aforementioned methods have a poor ability to depict the shine in the eyes or clearly show the hair, or give a sense of depth in portrait images or the like, and it is currently difficult to say these methods are suitable for recording images of people and the like.

SUMMARY OF THE INVENTION

The invention provides an ink jet recording medium capable of ink jet printing suitable for record of a portrait with sharpness of the image and sense of depth.

Namely, the invention provides an ink jet recording medium comprising a support and an ink receiving layer provided on at least one surface of the support. In a first embodiment of the invention, a center line average roughness average Ra of a surface of the ink-receiving layer, measured in accordance with ISO 4287 (1997) with a 2.5 mm measuring length and 0.8 mm cut-off value, is in a range of 0.3 μm or more but less than 0.8 μm, and an image clarity of the surface of the ink receiving layer, measured in accordance with ISO 10216 (1992), is in a range of 2 to 40%.

In a second embodiment of the invention, a center line average roughness average Ra of the surface of the support, measured in accordance with ISO 4287 (1997) with a 2.5 mm measuring length and 0.8 mm cut-off value, is in a range of 0.35 μm or more but less than 0.8 μm, and an image clarity of a surface of the ink receiving layer, measured in accordance with ISO 10216 (1992), is in a range of 2 to 40%.

In one aspect of the invention, a specular reflectivity of the support relative to light having a wavelength of 440 μm is in a range of 2 to 10%.

In another aspect of the invention, a haze value of the ink receiving layer is in a range of 3 to 40%.

In another aspect of the invention, the ink receiving layer comprises: at least one kind of water-soluble resin selected from the group consisting of polyvinyl alcohol resins, cellulose resins, resins having ether bonding, resins having a carbamoyl group, resins having a carboxyl group, and gelatin; and at least one kind of microparticle selected from the group consisting of silica fine particles, colloidal silica, alumina fine particles, and pseudo boehmite.

DETAILED DESCRIPTION OF THE INVENTION

A first embodiment of the ink jet recording medium of the present invention has a support and an ink receiving layer provided on at least one surface of the support. A center line average roughness average Ra of the surface of the ink-receiving layer (hereinafter sometimes simply referred as "Ra"), measured with a 2.5 mm measuring length and 0.8 mm cut-off value as defined in ISO 4287 (1997), is in a range of 0.3 μm or more but less than 0.8 μm. An image clarity of the surface of the ink receiving layer (hereinafter sometimes simply referred as "image clarity") as defined in ISO 10216 (1992) is in a range of 2 to 40%.

The present invention is able to provide the ink jet recording medium that provides a ink jet print having a sharpness and a sense of depth and is excellent in recordings of images of people or the like by setting the range of the center line average roughness average Ra of the surface of the ink-receiving layer. The "people or the like" used herein is not particularly limited, and naturally includes animals having hairs and eyes, things requiring a sense of depth and the like in a scope thereof.

The enter line average roughness average Ra of the surface of the ink-receiving layer is further preferably in a range of 0.35 μm or more but less than 0.8 μm, in view of suppressing excessive glossiness of an image surface.

While the method for restricting Ra on the surface of the ink-receiving layer to within the range as described above includes methods (1) to (4), the method is not restricted thereto:

(1) a method of controlling Ra on the surface of the ink-receiving layer by providing fine particles contained in the ink receiving layer, (2) a method of providing the ink-receiving layer on a support subjected in advance to an embossing treatment, (3) a method of subjecting the surface to an embossing treatment after providing an ink-receiving layer on a support, and (4) a method for providing a glossy layer on an ink-receiving layer.

Specifically, the surface Ra may be controlled in method (1) by adjusting the amount of addition of matting agent and latex particles, inorganic fine particles and organic fine particles, each having a different particle diameter, in the ink receiving layer.

The surface Ra may be controlled in method (2) by forming microscopic roughened patterns by pressing an embossing roller onto the surface after coating a molten polyolefin resin on the base paper using an extruder.

The surface Ra may be controlled in method (3) by subjecting the surface of the ink-receiving layer to treatment with an embossing calender.

The surface Ra may be controlled in method (4) by providing a coating layer with a thickness of up to several micrometers on the ink receiving layer to give glossiness, followed by calender treatment or pressing with a specular roll, as required.

While the method for controlling Ra is not particularly restricted, the above methods (1) and (2) are economically preferable.

The relation between the surface roughness Ra of the support and the surface roughness Ra of the ink-receiving layer cannot be discussed in sweeping terms since there are various methods of controlling surface roughness, as mentioned above. However, if the pigment of the ink-receiving layer is, for example, a formulation for a so-called photograph-like ink jet receiving layer using ultra-fine particles with a diameter of the order of several nanometers, such as vapor-phase silica; the formulation of coating liquid for the ink-receiving layer, the dispersion conditions of particles, the drying conditions, and the like are all the same; and the thickness of the coating film of the ink-receiving layer is about 20 to 40 μm; then, the surface roughness Ra of the ink-receiving layer will be approximately proportional to the surface roughness Ra of the support, and the surface roughness Ra of the ink-receiving layer will be slightly improved compared to the surface roughness of the support as the thickness of the coating film increases.

However, the argument above is not valid when the surface of the ink-receiving layer is subjected to an embossing calender treatment, or even when the formulation of the coating solution for the ink-receiving layer is the same if the dispersion state of particles is different.

In conventional ink jet receiving paper using pigment particles of several μm order, rather than photograph-like paper, the surface roughness Ra of the ink receiving layer is determined by the formulation of the coating liquid of the ink receiving layer (particularly the particle diameter of the pigment and pigment/binder ratio) while the surface roughness Ra of the support has little influence.

The support is preferably an opaque support with an image clarity on the surface at the side for providing the ink-receiving layer of preferably 2 to 40%, more preferably 2 to 35%, and still more preferably 2 to 30%. Image clarity (glossiness) is determined according to ISO 10216 (1992) for anodic oxide coatings of aluminum and aluminum alloys. The image is endowed with clarity (sharpness) and sense of depth by providing image clarity values in the range as described above.

While methods for adjusting image clarity of the surface of the ink-receiving layer to the range as described above include the following methods, they are not restricted thereto.

(1) methods for controlling the CLA roughness average Ra of the surface of the support, (2) methods for controlling the surface roughness Ra of the ink-receiving layer, (3) methods for controlling a specular reflectivity of the support relative to a light having a wavelength of 440 nm, and (4) methods for controlling haze of the ink-receiving layer.

Specifically, the method of (1) can control the image clarity values by controlling the Ra by embossing the support; or by extruding polyolefin resin and coating the base paper, after which pressure is applied by an embossing roller to form microscopic roughened patterns.

Image clarity may be controlled in method (2) by controlling the Ra of the ink-receiving layer as mentioned above.

Image clarity may be controlled in method (3) by adding particles having a high refractive index into the polyolefin resin layer on the base paper, by forming air bubbles in the polyolefin resin layer, or by applying particles having a high refractive index onto the support.

Image clarity can be controlled in method (4) by reducing the primary particle size of fine particles in the ink-receiving layer, by enhancing the dispersibility of the fine particles by reducing the secondary particle size, or by optimizing the ratio between the fine particles and binder.

While the method for controlling image clarity of the surface of the ink-receiving layer is not particularly restricted, from the above the methods in (3) and (4) are preferable considering the effectiveness thereof.

Ink Jet Recording Medium

The ink jet recording medium of the present invention comprises an ink-receiving layer provided on at least one surface of the support with the CLA surface roughness average (Ra).

The ink receiving layer of the ink jet recording medium according to this aspect can be formed, for example, by: forming a coating layer by applying a first liquid containing fine particles, a water-soluble resin, a cross-linking agent and a first metal compound onto the support; applying, for example, a second liquid containing a second metal compound on the coating layer either (1) at the same time when the first liquid is applied or (2) during drying of the coating layer formed by applying the first liquid, and before the coating liquid exhibits a decreasing rate of drying; and thus forming the coating layer on the support by cross-linking hardening.

The constituting components of the ink receiving layer will be described in detail hereinafter.

Ink Receiving Layer

The constituting components of the ink receiving layer are not particularly restricted, and may be appropriately selected depending on the intended use.

Fine Particles

The ink-receiving layer of the invention preferably contains fine particles. While the fine particles may be either organic fine particles or inorganic fine particles, inorganic fine particles are preferable from the view point of ink absorbability and drying properties. The first liquid is preferably formulated using the fine particles.

Examples of inorganic particles include silica particles such as fumed silica and water-containing silica particles, colloidal silica, alumina particles, titanium dioxide, barium sulfate, calcium silicate, zeolite, kaolinite, halloysite, mica, talc, calcium carbonate, magnesium carbonate, calcium sulfate, boehmite and pseudo boehmite, and preferably at least one kind of particles selected from silica particles, colloidal silica, alumina particles, and pseudo boehmite.

These can be used singly or in combination. The inorganic particles are preferably dispersed by a cationic resin.

Especially, the fumed silica is preferably used as the inorganic particles, and the fumed silica and the other inorganic particles can be used in combination. When the fumed silica and the other inorganic particles are used in combination, the amount of the fumed silica which occupy in the total mass of the inorganic particles is preferably 90% by mass or more, and more preferably 95% by mass or more.

The silica particles are usually divided roughly into wet process particles and dry process particles (vapor phase process). In the wet process, active silica is produced by acid decomposing of silicate salt, and water-containing silica is obtained by polymerizing the active silica moderately, cohering and submerging. On the other hand, in a vapor phase method, a flame hydrolysis method and an arc method are main current. In the flame hydrolysis method, anhydrous silica is obtained by a high temperature vapor phase hydrolysis of halogenated silicon. In the arc method, silicon and coke are heated, reduced and vaporized in an electric furnace by arc, and the anhydrous silica is obtained by oxidizing the resultant mixture by air. The "fumed silica" refers to anhydrous silica particles obtained by the vapor phase method.

Since the fumed silica have the density and the empty hole of the silanol group of the surface which are different from that of the water-containing silica, the fumed silica shows different property, and is suitable for forming a three-dimensional structure having high void ratio. The reason is not clear. It is considered that the density of silanol group on the surface of the fine particle is 5 to 8 pieces/nm$^2$ in the water-containing silica and thereby the silica particles aggregate easily. On the other hand, it is considered that the density of silanol group on the surface of the fine particle is 2 to 3 pieces/nm$^2$ and the silica particles flocculate, and thereby the void ratio is high.

Since the fumed silica has a large specific surface area especially, the silica has high ink absorption property and high holding efficiency. Since the silica has low refractive index, the transparency can be imparted to the ink receiving layer when dispersing to appropriate particle diameter, and high color density and excellent color can be obtained. It is important that the receiving layer is transparent in view of obtaining high color density and excellent color glossiness even when applying to photographic glossy paper or the like.

The average primary particle diameter of the fumed silica is preferably 20 nm or less, more preferably 10 nm or less, and most preferably 3 to 10 nm. The particles of the fumed silica adhere easily to each other by the hydrogen bonding due to the silanol group. When the average primary particle diameter is 20 nm or less, the structure having large void ratio can be formed. Therefore, the ink absorption property can be effectively improved, and the transparency and surface glossiness of the ink receiving layer can be improved. The fumed silica may be used in the state of primary order particle, and in the state of secondary particle.

The fumed silica is preferably used in a dispersed state. The fumed silica can be dispersed by using a cationic resin as a dispersing agent (a cohesion preventing agent), and can be used as a fumed silica dispersion. The cationic resin is not particularly limited. However, a cationic polymer such as a primary, secondary or tertiary amino group and the salt thereof, and a quaternary ammonium base are preferable, and the examples thereof include the examples of other mordant components described below. A silane coupling agent is also preferably used as a dispersing agent. Water soluble type or water emulsion type or the like can be preferably used. Examples include dicyan diamide-formalin condensation polymer such as dicyan based cationic resin, dicyan amide-diethylene triamine condensation polymer such as polyamine based cationic resin, epichlorhydrin-dimethylamine addition polymer, dimethyl diaryl ammonium chloride-$SO_2$ copolymer, diaryl amine salt-$SO_2$ copolymer, dimethyl diaryl ammonium chloride polymer, polymer of aryl amine salt, dialkyl amino ethyl(meth)acrylate quaternary salt polymer, poly cationic based cationic resin of acryl amide-diaryl amine salt copolymer.

Especially, it is preferable that the fumed silica has a specific surface area of 200 m$^2$/g or more as measured according to the BET method. The porous structure is obtained by containing the fumed silica, and thereby the ink absorption performance can be improved. The quick-drying performance and the ink bleeding properties can be improved by using the silica particles having a specific surface area of 200 m$^2$/g or more, and thereby the image quality and the printing density can be improved.

Herein, the BET method is one of methods for measuring the surface area of particle by a vapor phase adsorption method, and a method for obtaining a total surface area of the sample of 1 g, that is, a specific surface area from an adsorption isotherm. Nitrogen gas is usually used as an adsorption gas, and the amount of adsorption is generally measured from the change in the pressure or volume of an adsorbed gas. There is a Brunauer Emmett and Teller (BET) equation which shows the isotherm of multimolecular adsorption. The amount of adsorption is obtained based on the equation, and the surface area is obtained by multiplying the amount of adsorption by the area that one adsorption molecule occupies on the surface.

Water-Soluble Resin

The ink receiving layer of the medium of this embodiment of the present invention preferably contains a water-soluble resin. The first liquid is preferably constituted by using a water-soluble resin. Any water-soluble resin can be used in the invention, and examples thereof include polyvinyl alcohol resins such as polyvinyl alcohol (PVA) or modified polyvinyl alcohol; polyvinyl acetal, cellulose resins such as methyl cellulose (MC), ethyl cellulose (EC), hydroxy ethyl cellulose (HEC), or carboxymethylcellulose (CMC); chitins; chitosans; starches; resins having ether bonding such as polyethylene oxide (PEO), polypropylene oxide (PPO), polyethylene glycol (PEG), or polyvinyl ether (PVE); resins having an amid group or amide bonding such as polyacrylamide (PAAM) or poly vinylpyrrolidone (PVP); resins having a carbamoyl group; resins having a carboxyl group as a dissociated group such as polyacrylate, a maleic acid resin, alginate; and gelatins. Among these, in view of dispersibility of particles, at lease one kind of water-soluble resin selected from the group consisting of polyvinyl alcohol resins, cellulose resins, resins having ether bonding, resins having a carbamoyl group, resins having a carboxyl group, and gelatin is preferably contained in the ink receiving layer.

These can be also used singly or in combination.

Polyvinyl alcohol resin (hereinafter also referred to as simply "polyvinyl alcohol") is preferable among them, and the polyvinyl alcohol resin can be used in combination with other water-soluble resins. When the polyvinyl alcohol resin and other water-soluble resins are used in combination, the amount of the polyvinyl alcohol resin relative to the total mass of the water-soluble resins is preferably 90% by mass or more, and more preferably 95% by mass or more.

The scope of the polyvinyl alcohol resin includes cation-modified polyvinyl alcohol, anion-modified polyvinyl alcohol, silanol-modified polyvinyl alcohol, and other polyvinyl alcohol derivatives in addition to polyvinyl alcohol (PVA). The polyvinyl alcohol resin can be used singly or in combination.

The polyvinyl alcohol (PVA) has a hydroxyl group in the structure unit thereof. The hydroxyl group and the silanol group formed on the surface of silica particles forms the hydrogen bonding, and the three-dimensional network structure for making the secondary particles of the silica particles a unit chain is easily formed. The ink receiving layer of the porous structure having high void ratio can be formed by forming the three-dimensional network structure.

Thus, the ink receiving layer having porous structure rapidly absorbs ink by capillary phenomenon at the time of the ink jet recording, and can form excellent round dots without ink bleeding.

The content of the water-soluble resin (particularly, polyvinyl alcohol) is preferably 9 to 40% by mass, and more preferably 12 to 33% by mass based on the total solid mass of the layer when the ink receiving layer is formed in view of preventing the reduction of the film strength due to an excessively few amount and a crack at drying, and in view of preventing ink absorption property from reducing by reducing the void ratio due to the excessive much amount.

The number average degree of polymerization of the polyvinyl alcohol (PVA) is preferably 1800 or more, and more preferably 2000 or more in view of crack prevention. Further, PVA having a saponification degree of 88% or more is preferable, and PVA having a saponification degree of 95% or more is particularly preferable in view of viscosity and transparency of the coating liquid for forming the ink receiving layer.

Content Ratio of Inorganic Particles and Water-Soluble Resin

The content ratio of all inorganic particles (i) and all water-soluble resins (p) [PB ratio (i:p), namely, the mass of the inorganic particles relative to 1 part by mass of the water-soluble resin] influences the layer structure when the layer is formed. That is, the increase in PB ratio causes increases in the void ratio, the pore volume, and the surface area (per unit mass). The PB ratio is preferably in a range of 1.5:1 to 10:1 in view of preventing the reduction of film strength and the crack at the time of drying caused by the increase of the PB ratio, and preventing the reduction of the ink absorption property owing to the void to be easily blocked by resin to reduce the void ratio caused by the decrease of the PB ratio.

Since an ink jet recording medium is stressed when the ink jet recording medium passes the transportation system of an ink jet printer, the ink receiving layer should have sufficient film strength. The ink receiving layer should have sufficient film strength to prevent cracks and peelings of the ink receiving layer when cutting the ink jet recording medium into a sheet shape. Therefore, the PB ratio is preferably 6:1 or less, and more preferably 2:1 or more in view of securing the high-speed ink absorption property in the ink jet printer.

For example, when a coating liquid, in which the fumed silica having an average primary particle diameter of 20 nm or less and the water-soluble resin are completely dispersed in an aqueous solution with the PB ratio of 2:1 to 5:1, is coated on the support and thus formed coating layer is dried, a three-dimensional network structure which has the secondary particle of the silica particles as a chain unit is formed. A translucent porous membrane can be thus easily formed in which an average pore size is 30 nm or less; the void ratio is 50 to 80%; the pore ratio volume is 0.5 ml/g or more; and specific surface area is 100 $m^2/g$ or more.

Cross-Linking Agent

The ink receiving layer of the embodiment of the invention is preferably formed by the receiving layer-coating solution that contains a cross-linking agent.

The cross-linking agent is preferably contained in the first liquid, and may further be contained in the second liquid.

The cross-linking agent is a agent that can cross-link the water-soluble resin, and the porous layer can be formed by including the cross-linking agent which enables hardening the porous layer by cross-linking reaction between the cross-linking agent and the water-soluble resin.

A boron compound is preferable as the cross-linking agent that cross-links the water-soluble resin, specifically polyvinyl alcohol resins. Examples of the boron compound include borax, boric acid, borates (for example, orthoboric acid salt, $InBO_3$, $ScBO_3$, $YBO_3$, $LaBO_3$, $Mg_3(BO_3)_2$, $CO_3(BO_3)_2$, diboric acid salt (such as $Mg_2B_2O_5$ or $CO_2B_2O_5$), meta-borates (such as $LiBO_2$ or $Ca(BO_2)_2$, $NaBO_2$, $KBO_2$), tetraborates (such as $Na_2B_4O7.10H_2O$) and pentaborates (such as $KB_5O_8.4H_2O$, $Ca_2B_6O_{11}.7H_2O$, or $CsB_5O_5$). The borax, the boric acid, and the borates are preferable among them with a view to enabling the prompt cross-linking reaction, and the boric acid is particularly preferable.

The following compounds can be used in addition to the boron compound. Examples of such additional compound include aldehyde compounds such as formaldehyde, glyoxal or glutalaldehyde; ketone compounds such as diacetyl or cyclopentanedione; activated halogenated compounds such as bis(2-chloroethylurea)-2-hydroxy 4,6-dichloro-1,3,5-triazine or 2,4-dichloro-6-S-triazine sodium salt; activated vinyl compounds such as divinyl sulfonic acid, 1,3-vinylsulfonyl-2-propanol, N,N'-ethylene bis(vinylsulfonyl acetamido), or 1,3,5-triacryloyl-hexahydro-S-triazine; N-methylol compound such as dimethylol urea or methyloldimethylhydantoin; melamine resins such as methylol melamine and alkylated methylol melamine; epoxy resin;

isocyanate compounds such as 1,6-hexamethylene diisocyanate; aziridine compounds such as those described in U.S. Pat. No. 3,017,280 or 2,983,611; carboxyimide compounds such as those described in U.S. Pat. No. 3,100,704; Epoxy compounds such as glycerol triglycidyl ether; ethyleneimino compounds such as 1,6-hexamethylene-N,N'-bis ethylene urea; halogenated carboxy aldehyde compounds such as mucochlor acid or mucophenoxychlor acid; dioxane compounds such as 2,3-dihydroxy dioxane; metal-containing compounds such as titanium lactate, aluminum sulfate, chrome alum, potassium alum, zirconyl acetate or chrome acetate; polyamine compounds such as tetraethylenepentamine; hydrazide compounds such as adipic dihydrazide; and low molecule compounds or polymers which contain two or more of oxazolin groups. The cross-linking agent may be used singly or in combination.

The cross-linking agent may be added to the coating liquid for the ink receiving layer and/or the coating liquid for forming a layer adjacent to the ink receiving layer when the coating liquid for the ink receiving layer is coated. Alternatively, the cross-linking agent may be supplied to the ink receiving layer by coating the coating liquid for the ink receiving layer on the support on which the coating liquid which includes the cross-linking agent is coated beforehand, or by overcoating the second liquid (for example, a cross-linking agent solution) after coating and drying the coating liquid for the ink receiving layer which contains the cross-linking agent or contains no cross-linking agent.

The cross-linking agent can be provided to the invention as follows. Here, boron compound will be used as an example of the cross-linking agent. When the ink receiving layer is formed by coating a coating liquid for an ink receiving layer (first liquid) and hardening by cross-linking, the hardening and cross-linking is conducted by providing the second liquid at (1) a simultaneous timing with coating of the first liquid so as to form the coating layer or (2) a timing before the coating layer formed by coating the first liquid exhibits a decreasing rate of drying during drying of the coating layer. The boron compound as a cross-linking agent may be contained either in the first liquid or in the second liquid, and may be contained in both liquids. When the ink receiving layer is formed to have multiple layers, two or more of the coating liquids can be over-layer coated, and the second liquid may be applied on the formed multiple layers.

The amount of the cross-linking agent to be used is preferably in a range of 1 to 50% by mass relative to the mass of the water-soluble resin contained in the ink receiving layer, and more preferably in a range of 5 to 40% by mass.

Metal Compound

The ink receiving layer of the embodiment of the invention is preferably formed by the receiving layer-coating solution (first liquid) that contains a metal compound. The metal compound may further be contained in the second liquid.

The first metal compounds contained in the first liquid are preferably acid metal compounds and examples thereof include polyvalent water-soluble metal salts and hydrophobic metal salt compounds. Specific examples thereof include a metal salt or a complex selected from the group consisting of magnesium, aluminum, calcium, scandium, titanium, vanadium, manganese, iron, nickel, zirconium, copper, zinc, gallium, germanium, strontium, yttrium, molybdenum, indium, barium, lanthanum, cerium, praseodymium, neodymium, samarium, europium, gadolinium, dysprosium, erbium, ytterbium, hafnium, tungsten and bismuth.

Further specific examples thereof include calcium acetate, calcium chloride, calcium formate, zirconium acetate, zirconium nitrate, ammonium zirconium carbonate, zirconium tetrachloride, calcium sulfate, barium acetate, barium sulfate, barium phosphate, manganese chloride, manganese acetate, manganese formate dihydrate, ammonium manganese sulfate hexahydrate, cupric chloride, ammonium chloride copper (II) dihydrate, copper sulfate, cobalt chloride, cobalt thiocyanate, cobalt sulfate, nickel sulfate hexahydrate, nickel chloride hexahydrate, nickel acetate tetrahydrate, ammonium nickel sulfate hexahydrate, nickel amidosulfate tetrahydrate, aluminum sulfate, aluminum alum, basic poly aluminum hydroxide, aluminum sulfite, aluminum thiosulfate, aluminum polychloride, aluminum nitrate enneahydrate, aluminum chloride hexahydrate, ferrous bromide, ferrous chloride, ferric chloride, ferrous sulfate, ferric sulfate, zinc phenol sulfonate, zinc bromide, zinc chloride, zinc nitrate hexahydrate, zinc sulfate, zinc acetate ammonium, zinc ammonium carbonate, titanium tetrachloride, tetra isopropyl titanate, titanium acetylacetonate, titanium lactate, chromium acetate, chromic sulfate, magnesium sulfate, magnesium chloride hexahydrate, magnesium citrate enneahydrate, phosphorus sodium tungstate, tungsten sodium citrate, 12 tungst phosphate n hydrate, 12 tungst silicate 26 hydrate, molybdenum chloride, 12 molybden phosphate n hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerous chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride, bismuth nitrate.

Among these, aluminum sulfate, aluminum alum, basic polyaluminum hydroxide, aluminum sulfite, aluminum thiosulfate, aluminum polychloride, aluminum nitrate enneahydrate, aluminum chloride hexahydrate, zirconium acetate, zirconium nitrate, ammonium zirconium carbonate, and zirconium tetrachloride are preferable.

The first liquid preferably contains at least two kinds of the first metal compounds. Since different metal compounds serve to mordant different dyes, mordanting may be enhanced by using at least two kinds of the first metal compounds. Accordingly, it is specifically preferable to include the metal compounds for mordanting at least two kinds of dyes in the first liquid. While a variety of combinations may be considered as the metal compounds corresponding to the dyes, zirconium compounds, for example, are effective for black dyes in commonly used inks.

The content of the first metal compound in the first liquid is preferably 0.01 to 1% by mass, more preferably 0.05 to 0.8% by mass, relative to the total mass of the first liquid. An ink jet recording medium that does not give deteriorated curl at low humidity and gives little bleeding of the image with time may be prepared by adjusting the content of the first metal compound to within the range as described above. When other mordant components, as will be described hereinafter, are used together, they may be included so that the total mordant content is within the range as described above, a range in which the effect of the invention is not impaired.

Any metal compound that is stable under basic can be used as the second metal compound to be used in the second liquid without limitation. Preferable examples of the metal compound include a metal salt, a metal complex compound, an inorganic oligomer and an inorganic polymer. Preferable example thereof include the metal compounds listed as inorganic mordants described below. Among these, zirconium compounds, aluminum compounds, and the zinc compounds are preferable as the metal compound, and zirconium compounds are particularly preferable. Examples of the zirconium compounds include ammonium zirconium carbonate, ammonium zirconium nitrate, potassium zirconium carbonate, ammonium zirconium citrate, zirconyl stearate, zirconyl octyl, zirconyl nitrate, zirconium oxychloride and zirconium hydroxychloride. The ammonium zirconium carbonate is particularly preferable. The second liquid may additionally contain two or more kinds of other mordant components as described below in combination as required.

Metal complexes described in "Kagaku Sosetu (Chemistry Review) No. 32 (1981)" (edited by the Chemical Society of Japan) and transition metal complexes containing a transition metal such as ruthenium described in "Coordination Chemistry Review", Vol. 84, pp. 85-277 (1988) and in Japanese Patent Application Laid-Open (JP-A) No. 2-182701 can be used as the metal complex compound.

The content of the second metal compound in the second liquid is preferably in the range of 0.1 to 0.8% by mass, more preferably to within the range of 0.2 to 0.5% by mass, relative to the total mass of the second liquid. Glossiness may be improved without deteriorating bronzing by adjusting the content of the second metal compound in the range as described above. When other mordant components, as will be described hereinafter, are used together, they may be included so that the total mordant content is within the range as described above, a range in which the effect of the invention is not impaired.

The second liquid may contain a basic compound.

Examples of the basic compound include an ammonium salt of weak acid, an alkali metal salt of weak acid (for example, lithium carbonate, sodium carbonate, potassium carbonate, lithium acetate, sodium acetate and potassium acetate), an alkali earth metal salt of weak acid (for example, magnesium carbonate, barium carbonate, magnesium acetate and barium acetate), hydroxide of alkali metal and alkali earth metal, hydroxy ammonium, ammonia, a primary, a secondary, or a tertiary amine (for example, ethylamine, dimethylamine, triethylamine, polyallylamine, tripropyleneamine, tributylamine, trihexylamine, dibutylamine and butylamine, N-ethyl-N-methyl butylamine), a primary-a tertiary aniline (for example, diethylaniline, dibutylaniline, ethylaniline and aniline), pyridine which may have a substituent (for example, 2-amino pyridine, 3-amino pyridine, 4-amino pyridine, 4-(2-hydroxyethyl)-amino pyridine). Among the above, an ammonium salt of weak acid is particularly preferable.

The weak acid is an acid in which pKa is 2 or more in the inorganic acid and the organic acid described in chemical handbook basic chapter II (Maruzen Co., Ltd.) or the like. Examples of the ammonium salt of weak acid include ammonium carbonate, ammonium hydrogencarbonate, ammonium boric acid, and ammonium acetate. However, the ammonium salt of weak acid is not limited to these examples. Ammonium carbonate, ammonium hydrogen carbonate and ammonium carbamate are preferable among them since they do not remain in the layer after being dried, and thereby the ink bleeding can be reduced. Two or more of the basic compound may be used in combination thereof.

The basic compound is contained in the second liquid preferably in an amount of 0.5 to 10% by mass, and more preferably 1 to 5% by mass based on the total mass of the second liquid including the solvent thereof. When the content of the basic compound is adjusted in the above-described particular range, a sufficient hardening degree can be obtained without increasing a concentration of ammonia which may deteriorate working environments.

Surfactant

The ink receiving layer of the embodiment of the invention can be formed by the receiving layer-coating solution that contains a surfactant.

The surfactant is preferably contained in the first liquid. Examples of the surfactant include cationic surfactants, anionic surfactants, nonionic surfactants, amphoteric surfactants, fluorine surfactants, and silicon surfactants. These surfactants may be used singly or in combination thereof.

Examples of the nonionic surfactants include polyoxyalkylenealkylether and polyoxyalkylenealkylphenylethers (for example, diethylene glycol monoethyl ether, diethylene glycoldiethyl ether, polyoxy ethylene laurylether, polyoxy ethylene stearylether, polyoxy ethylene nonylphenyl ether or the like), oxyethylene oxypropylene block copolymer, sorbitan fatty acid esters (for example, sorbitan mono laurate, sorbitan monoorate, sorbitan triorate or the like), polyoxyethylene sorbitan fatty acid esters (for example, polyoxyethylene sorbitan mono laurate, polyoxyethylene sorbitan monoorate, polyoxyethylene sorbitan mono triorate or the like), polyoxyethylenesorbitol fatty acid esters (for example, polyoxyethylene sorbit tetraoleate or the like), glycerin fatty acid esters (for example, glycerol mono orate or the like), polyoxyethylene glycerin fatty acid esters (monostearate polyoxyethylene glycerin, monooleate polyoxyethylene glycerin or the like), polyoxyethylene fatty acid esters(polyethylene glycol mono laurate, polyethylene glycol monoorate or the like), polyoxyethylene alkylamine, acetylenic glycols (for example, 2,4,7,9-tetramethyl-5-desine-4,7-diol and ethylene oxide addition of the diol, propylene oxide addition or the like). Polyoxyalkylene alkylethers are preferable. The nonionic surfactants may be included in the coating liquid for forming the ink receiving layer.

Examples of the amphoteric surfactants include an amino acid surfactant, a carboxy ammonium betaine surfactant, a sulfone ammonium betaine surfactant, an ammonium sulfate betaine surfactant and imidazolium betaine surfactant. For example, the amphoteric surfactants which are described in U.S. Pat. No. 3,843,368, JP-A Nos. 59-49535, 63-236546, 5-303205, 8-262742 and 10-282619 or the like can be preferably used. An amino acid amphoteric surfactant is preferable as the amphoteric surfactant. The amino acid type amphoteric surfactant is derivatized from an amino acid (glycine, glutamic acid, and histidine acid or the like) as described in JP-A No. 5-303205. Examples of the amino acid amphoteric surfactants include N-amino acyl acid in which a long-chain acyl group is introduced and salts thereof.

Examples of the anionic surfactants include a fatty acid salt (for example, sodium stearate and potassium oleate), an alkyl sulfate ester salt (for example, sodium lauryl sulfate, triethanol amine lauryl sulfate), a sulfonate (for example, sodium dodecylbenzenesulfonate), an alkylsulfo succinic acid salt (for example, dioctylsulfo sodium succinate), alkyldiphenylether disulfonate and alkyl phosphate.

Examples of the cationic surfactants include alkyl amine salt, a quaternary ammonium salt, a pyridinium salt, an imidazolium salt.

Examples of the fluorine surfactants include compounds derivatized through the intermediate having parfluoro alkyl group by using a method such as an electrolysis fluorination, telomerization and oligomerization. Examples include parfluoro alkyl sulfonate, parfluoro alkylcarboxylate, parfluoro alkylethyleneoxide additament, parfluoro alkyl trialkyl ammonium salt, parfluoro alkyl group-containing oligomer, parfluoro alkyl phosphate ester and the like.

A silicon oil modified by an organic group is preferable as the silicon surfactant, and may have the structure in which the side chain of the siloxane structure is modified by the organic group, the structure in which both terminals are modified, and the structure in which a terminal is modified. Examples of the organic group modification include amino modification, polyether modification, epoxy modification and carboxylic modification, carbinol modification, alkyl modification, aralkyl modification, phenol modification, and fluorine modification.

The content of the surfactant contained in the coating liquid for forming the ink receiving layer is preferably in a range of 0.001 to 2.0%, more preferably in a range of 0.01 to 1.0%.

Other Mordant Components

In addition to the above-described metal compound, the ink receiving layer of the embodiment of the invention can include other mordant components in order to further improve resistances against image bleeding property during storage and water proof property.

Examples of the other mordant components include an organic mordant such as a cationic polymer (a cationic mordant) and an inorganic mordant such as a water-soluble metal compound. A cationic mordant is preferably a polymer mordant having a primary, secondary or tertiary amino group, or a quaternary ammonium group as a cationic functional group. A cationic non-polymer mordant can be also used.

The polymer mordant is preferably a homopolymer of a monomer (mordant monomer) having a primary, secondary or tertiary amino group and its salt, or a quaternary ammonium group, a copolymer or a condensation polymer of a mordant monomer and other monomer(s) (non-mordant monomer(s)). The polymer mordants can be used in the form of a water-soluble polymer or water dispersible latex particles.

Examples of the mordant monomers include compounds which are quaternized with methyl chloride, ethyl chloride, methylbromide, ethylbromide, methyliodide or ethyliodide, and a sulfonate, an alkyl sulfonate, an acetate or an alkyl carboxylate and the like which substitute anions thereof, in which the examples of the compounds to be quaternized include trimethyl-p-vinyl benzyl ammonium chloride, trimethyl-m-vinyl benzyl ammonium chloride, triethyl-p-vinyl benzyl ammonium chloride, triethyl-m-vinyl benzyl ammonium chloride, N,N-dimethyl-N-ethyl-N-p-vinyl benzyl ammonium chloride, N,N-diethyl-N-methyl-N-p-vinyl benzyl ammonium chloride, N,N-dimethyl-N-n-propyl-N-p-vinyl benzyl ammonium chloride, N,N-dimethyl-N-n-octyl-N-p-vinyl benzyl ammonium chloride, N,N-dimethyl-N-benzyl-N-p-vinyl benzyl ammonium chloride, N,N-diethyl-N-benzyl-N-p-vinyl benzyl ammonium chloride, N,N-dimethyl-N-(4-methyl)benzyl-N-p-vinyl benzyl ammonium chloride, N,N-dimethyl-N-phenyl-N-p-vinyl benzyl ammonium chloride;

trimethyl-p-vinyl benzyl ammonium bromide, trimethyl-m-vinyl benzyl ammonium bromide, trimethyl p-vinyl benzyl ammonium sulfonate, trimethyl-m-vinyl benzyl ammonium sulfonate, trimethyl-p-vinyl benzyl ammonium acetate, trimethyl-m-vinyl benzyl ammonium acetate, N,N,N-triethyl-N-2-(4-vinylphenyl)ethyl ammonium chloride, N,N,N-triethyl-N2-(3-vinylphenyl)ethyl ammonium chloride, N,N-diethyl-N-methyl-N2-(4-vinylphenyl)ethyl ammonium chloride, N,N-diethyl-N-methyl-N2-(4-vinylphenyl)ethyl ammonium acetate;

N,N-dimethyl aminoethyl(meth)acrylate, N,N-diethyl aminoethyl(meth)acrylate, N,N-dimethyl aminopropyl (meth)acrylate, N,N-diethyl aminopropyl(meth)acrylate, N,N-dimethyl aminoethyl(meth)acrylamide, N,N-diethyl aminoethyl(meth)acrylamide, N,N-dimethyl amino propyl (meth)acrylamide, and N,N-diethyl amino propyl(meth) acrylamide.

Examples of the compounds include monomethyl diallyl ammonium chloride, trimethyl-2-(methacryloyloxy)ethyl ammonium chloride, triethyl-2-(methacryloyloxy)ethyl ammonium chloride, trimethyl-2-(acryloyloxy)ethyl ammonium chloride, triethyl-2-(acryloyloxy)ethyl ammonium chloride, trimethyl-3-(methacryloyloxy)propyl ammonium chloride, triethyl-3-(methacryloyloxy)propyl ammonium chloride, trimethyl-2-(methacryloylamino)ethyl ammonium chloride, triethyl-2-(methacryloylamino)ethyl ammonium chloride, trimethyl-2-(acryloylamino)ethyl ammonium chloride, triethyl-2-(acryloylamino)ethyl ammonium chloride, trimethyl-3-(methacryloylamino)propyl ammonium chloride, triethyl-3-(methacryloylamino)propyl ammonium chloride, trimethyl 3-(acryloylamino)propyl ammonium chloride, triethyl-3-(acryloylamino)propyl ammonium chloride;

N,N-dimethyl-N-ethyl-2-(methacryloyloxy)ethyl ammonium chloride, N,N-diethyl-N-methyl-2-(methacryloyloxy) ethyl ammonium chloride, N,N-dimethyl-N-ethyl-3-(acryloylamino)propyl ammonium chloride, trimethyl-2-(methacryloyloxy)ethyl ammonium bromide, trimethyl-3-(acryloylamino)propyl ammonium bromide, trimethyl-2-(methacryloyloxy)ethyl ammonium sulfonate, trimethyl-3-(acryloylamino)propyl ammonium acetate. Examples of the other monomers capable of being copolymerized include N-vinyl imidazole and N-vinyl-2-methylimidazole. The vinyl amine unit can be obtained by the hydrolysis after polymerized by using the polymerization unit of N-vinyl acetamide and N-vinyl formamide or the like, and its salt can be also used.

The "non-mordant monomer" means a monomer which does not contain a primary, secondary or tertiary amino group and its salt, or the basic or the cationic moiety of a quaternary ammonium base group or the like. The non-mordant monomer refers to a monomer that does not interact with dye contained in ink jet ink, or a monomer in which the interaction is substantially small. Examples of the non-mordant monomers include alkyl(meth)acrylate ester; cycloalkyl(methyl) acrylate ester such as cyclohexyl(meth)acrylate; ariel(meth) acrylate ester such as phenyl(meth)acrylate; aralkyl ester such as benzil(meth)acrylate; aromatic vinyls such as styrene, vinyl toluene or α-methyl styrene; vinylesters such as vinyl acetate, vinyl propionate or vinyl versatate; aryl esters such as allyl acetate; a halogen-containing monomer such as vinylidene chloride or vinyl chloride; vinyl cyanide such as (meth)acrylonitrile; and olefins such as ethylene or propylene.

The alkyl(meth)acrylate ester having 1 to 18 carbon atoms in an alkyl moiety thereof is preferable. Examples of alkyl (meth)acrylate esters include methyl(meth)acrylate, ethyl (meth)acrylate, propyl(meth)acrylate, isopropyl(meth)acrylate, n-butyl(meth)acrylate, isobutyl(meth)acrylate, t-butyl (meth)acrylate, hexyl(meth)acrylate, octyl(meth)acrylate, 2-ethyl hexyl(meth)acrylate, lauryl(meth)acrylate and stearyl (meth)acrylate. Methyl acrylate, ethyl acrylate, methyl methacrylate, ethyl methacrylate and hydroxy ethyl methacrylate are preferable among them. The non-mordant monomers can be also used singly or in combination.

Further, preferable examples of the polymer mordants include polydiallyldimethyl ammonium chloride, polymethacryloyloxyethyl-β-hydroxy ethyl dimethyl ammonium chloride, polyethylenimine, polyallylamine and the modified body, polyallylamine hydrochloride, a polyamide-polyamine resin, cationized starch, dicyandiamide formalin condensate, dimethyl-2-hydroxy propyl ammonium salt polymer, polyamidine, polyvinyl amine, and cationic polyurethane resins described in JP-A No. 10-86505.

The polyallylamine modified body is obtained by adding 2 to 50 mol % of acryl nitrile, chloromethylstyrene, TEMPO, epoxy hexane, and sorbic acid or the like to polyallylamine. The polyallylamine modified body obtained by adding 5 to 10 mol % of acryl nitrile, chloromethylstyrene, TEMPO to polyacrylamine is preferable. Especially, the TEMPO adduct of polyallylamine which is obtained by adding 5 to 10 mol % of TEMPO to polyallylamine is preferable in view of exhibiting ozone discoloring prevention effect.

The mordant has preferably a weight average molecular weight of 2,000 to 300,000. The molecular weight which is in the above-mentioned range can improve water resistance and resistance property against bleeding during storage.

Other Components

The ink receiving layer may further contain the following components if necessary.

In order to restrain the deterioration of the colorant, the ink receiving layer may contain a anti-fading agent such as various ultraviolet absorbing agents, surfactants, antioxidants and singlet oxygen quencher.

Examples of the ultraviolet absorbing agents include cinnamic acid derivative, benzophenone derivative and benzotriazolyl phenol derivative. Specific examples include α-cyano-phenylcinnamic acid butyl, o-benzotriazole phenol, o-benzotriazole-p-chlorophenol, o-benzotriazole-2,4-di-t-butyl phenol, and o-benzotriazole-2,4-di-t-octyl phenol. A hindered phenol compound can be also used as an ultraviolet absorbing agent, and preferable examples thereof include phenols in which at least one or more of the second place and the sixth place is substituted by a diverging alkyl group.

A benzotriazole ultraviolet absorbing agent, a salicylic acid ultraviolet absorbing agent, a cyano acrylate ultraviolet absorbing agent, and oxalic acid anilide ultraviolet absorbing agent or the like can be also used. For example, the ultraviolet absorbing agents are described in JP-A Nos. 47-10537, 58-111942, 58-212844, 59-19945, 59-46646, 59-109055 and 63-53544, Japanese Patent Application Publication (JP-B) Nos. 36-10466, 42-26187, 48-30492, 48-31255, 48-41572 and 48-54965, 50-10726, U.S. Pat. Nos. 2,719,086, 3,707,375, 3,754,919 and 4,220,711 and the like.

A fluorescent whitening agent can be also used as an ultraviolet absorbing agent, and specific examples thereof include a coumalin fluorescent whitening agent. Specific examples are described in JP-B Nos. 45-4699 and 54-5324 and the like.

Examples of the antioxidants are described in EP 223739, 309401, 309402, 310551, 310552 and 459-416, D.E. Patent No. 3435443, JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 66-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437 and 5-170361, JP-B Nos. 48-43295 and 48-33212, and U.S. Pat. Nos. 4,814,262 and 4,980,275.

Specific examples of the antioxidants include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxy-diphenylamine, and 1-methyl-2-phenyl indole.

The anti-fading agents may be used singly or in combination of two or more thereof. The anti-fading agents may be water-solubilized, dispersed or emulsified, and can be contained in microcapsules. The amount of addition of the discolorating prevention agent is preferably in a range of 0.01 to 10% by mass relative to the mass of the coating liquid for forming the ink receiving layer.

In order to improve the dispersing property of inorganic particles, the ink receiving layer may contain various inorganic salts. Further, the ink receiving layer may contain acid and alkali as a pH adjuster. Furthermore, the ink receiving layer may contain metal oxide fine particles having electroconductivity in order to suppress the friction electrification and peeling electrification of the surface, and various mat agents in order to reduce the friction property of the surface.

Support

A transparent support which is made of transparent material such as plastic, and an opaque support which is composed of an opaque material such as paper can be used as a support for the embodiment of the invention.

Specifically, a transparent support or an opaque support having glossiness is preferably used to make the best use of the transparency of the ink receiving layer. Read-only optical disks such as CD-ROM or DVD-ROM, recordable optical disks such as CD-R or DVD-R, and rewritten optical disks can be used as the support, and the ink receiving layer can be formed on both sides of a label.

The support has a CLA surface roughness average Ra of preferably 0.3 μm or more but less than 1.0 μm, more preferably 0.35 μm or more but less than 1.0 μm, on the surface on which the ink receiving layer is provided. Furthermore, the support is preferably an opaque support with a surface roughness of 0.4 μm or more but less than 1.0 μm. Ra used herein has the same meaning as Ra used in the ink receiving layer described before.

Ra of the ink receiving layer may be readily controlled by adjusting the Ra of the support to within the range described above.

The Ra of the support after forming the ink receiving layer may be measured by removing the ink receiving layer.

The specular reflectivity of the support relative to a light having a wavelength of 440 nm is preferably 2% to 10%, more preferably 2.5% to 10%, and particularly preferably 3.0% to 10%, considering control of sharpness (resolution) and sense of depth.

Sharpness (resolution) may be controlled by adjusting the specular reflectivity from the lower side of the ink receiving layer to within the range above, tending to enable an image with sense of depth to be readily obtained.

The material which is transparent and can endure radiant heat when used on an OHP and a backlight display is preferable as materials which can be used for the transparent support. Examples of the materials include polyesters such as polyethylene terephthalate (PET); polysulfone, polyphenylene oxide, polyimide, polycarbonate and polyamide. The polyesters are preferable among them, and the polyethylene terephthalate is particularly preferable. The thickness of the transparent support is not particularly limited. In view of easy handling, the thickness is preferably in a range of 50 to 200 μm.

Examples of the opaque support include paper supports having high glossiness such as art paper, coat paper, cast coat paper or baryta paper used for a support for a silver salt photography or the like; polyesters such as polyethylene terephthalate (PET), cellulose esters such as nitrocellulose, cellulose acetate or cellulose acetate butilate, opaque high glossiness films which are constituted by containing white pigment or the like in plastic films such as polysulfone, polyphenylene oxide, polyimide, polycarbonate or polyamide (a surface calendar treatment may be performed); and, the supports in which the coating layer made of polyolefin which contains or does not contain the white pigment was formed on the surface of a high glossiness film which contains the various paper support, the transparent support or the white pigment or the like. A white pigment-containing foamed polyester film (for example, a foam PET which contains the polyolefin fine particles, and contains voids formed by drawing) is also preferable.

The thickness of the opaque support is not particularly limited. In view of easiness in handling, the thickness is preferably in a range of 50 to 300 μm.

One treated by a corona discharge treatment, a glow discharge treatment, a flame treatment and a ultraviolet radiation treatment or the like may be used for the surface of the support so as to improve wettability and adhesion property.

Next, base paper used for the paper support will be described in detail.

The base paper is made by using wood pulp as a main component, and is alternatively made by further using a synthetic pulp such as polypropylene or a synthetic fiber such as nylon and polyester in addition to the wood pulp in accordance with necessity. LBKP, LBSP, NBKP, NBSP, LDP, NDP, LUKP and NUKP can be used as the wood pulp. It is preferable to use LBKP, NBSP, LBSP, NDP and LDP, which contain a lot of short fibers, are contained in a larger amount (ratio) therein. The amount (ratio) of LBSP and/or LDP is preferable in the range of 10 to 70% by mass relative to a total mass of the pulp material used in the base paper. A chemical pulp that contains few impurities (such as sulfate pulp and sulfite pulp) is preferably used as the pulp, and a pulp in which whiteness is improved by bleaching is also useful.

Sizing agents such as higher fatty acid or alkyl ketene dimer, white pigments such as calcium carbonate, talc or titanium oxide, paper reinforcing agents such as starch, polyacrylamide or polyvinyl alcohol, fluorescent whitening agents, water retention agents such as polyethylene glycols, dispersing agents, and softening agents such as a quaternary ammonium can be properly added to the base paper.

The freeness of pulp used for papermaking is preferably in a range of 200 to 500 ml in the regulation of Canadian Standard Freeness (CSF). It is preferable that the length of pulp fiber after the pulp is beat is arranged so that the sum of the % by mass of 24 mesh-remainder and the % by mass of 42 mesh-remainder is in a range of 30 to 70% in the regulation of a conventional-known method of screening test of paper pulp (JIS P-8207). The % by mass of 4 mesh-remainder therein is preferably 20% by mass or less.

The weight of the base paper is preferably in a range of 30 to 250 g/m$^2$, and more preferably in a range of 50 to 200 g/m$^2$. The thickness of the base paper is preferably in a range of 40 to 250 μm. High flatness can be imparted to the base paper by calendar treatment at the making paper step or after making paper. The density of the base paper that is measured by ISO 534 (1988) is generally in a range of 0.7 to 1.2 g/m$^2$. In addition, the strength degree of the base paper that is measured by a conventional-known method for determination of stiffness of paper by Clark stiffness tester (JIS P-8143) is preferably in a range of 20 to 200 g.

A surface size agent may be coated on the surface of the base paper. The surface size agent which is added to the base paper can be similar to those which are added to the base paper as the size agent. It is preferable that the pH of the base paper that is measured by a hot water extraction method defined by ISO 1924-1 (1992) is in a range of 5 to 9 when measured.

In general, both surfaces of the base paper can be covered with polyethylene. The polyethylene mainly includes polyethylene having low density (LDPE) and/or polyethylene having high density (HDPE). Other LLDPE and the polypropylene or the like can be also used.

Specifically, as is similar to those widely performed in a field of printing paper for photograph, it is preferable that rutile type- or anatase type-titanium oxide, a fluorescent whitening agent and/or a ultramarine blue pigment are added to polyethylene in the polyethylene layer on which the ink receiving layer is formed thereon so as to improve an opaque degree, a whiteness and color. Herein, the content (amount) of titanium oxide is preferably in a range of about 3 to 20% by mass, and more preferably in a range of 4 to 13% by mass relative to a total amount of polyethylene contained in the polyethylene layer. The thickness of the polyethylene layer is not particularly limited, and is preferably in a range of 10 to 50 μm for layers formed on both surfaces of the base paper.

Further, a undercoat layer can be formed on the polyethylene layer so as to impart the polyethylene layer adhesion to the ink receiving layer. Hydrophilic polyester, gelatin, and PVA are preferably used as the undercoat layer. The thickness of the undercoat layer is preferably in a range of 0.01 to 5 μm.

A polyethylene-coated paper can be used as a glossy paper. Further, a paper, which has a mat surface or a matte surface which is similar to those obtained in usual photograph printing paper and is formed by performing so-called typing treatment when polyethylene is coated on a surface of a base paper by melting and extruding, can be also used.

The support of the present embodiment comprises a transparent support, such as a plastic, or an opaque support, such as paper, or any base material on which an ink-receiving layer can be formed. By "base material" is meant a transparent or opaque material subject to the polyethylene layer, the surface sizing treatment, the undercoat layer, the embossing treatment, or other treatments and the like. Any base materials capable of forming an ink-receiving layer thereon are applicable.

Method for Producing the Ink Jet Recording Medium

While a method for producing an embodiment of the ink jet recording medium according to the invention is described in detail hereinafter, it is not restricted thereto. The constituting components of the ink jet recording medium to be used herein are as described previously.

The method for producing the ink jet recording medium of this aspect is a WOW method (wet-on-wet method) comprising: forming a coating layer by applying onto a support a first liquid (sometimes referred to as an ink-receiving layer coating liquid) containing, for example, fine particles, a water soluble resin, a cross-linking agent and a first metal compound (coating process); and applying a second liquid (sometimes referred to as a basic solution hereinafter) containing a second metal compound on the coating layer either (1) at the same time that the first liquid is applied, or (2) during the drying of the coating layer formed by applying the first liquid, and before the coating liquid exhibits a decreasing rate of drying to carry out cross-linking curing of the coating layer (hardening process). By means of the hardening process, in which the coating layer applied on the support in the aforementioned coating process is cross-linked and hardened, the coating layer is formed into a cross-linked and hardened ink-receiving layer.

According to this embodiment, good film-forming ability capable of sufficiently hardening the film may be obtained by applying a coating layer comprising the first liquid containing the first metal compound in advance, followed by applying the second liquid containing the second metal compound onto this coating layer. The first and second metal compounds (and other mordant components) serve as mordants to enable an ink jet recording medium to be obtained, wherein ink, particularly dyes are sufficiently mordanted to offer images excellent in print density and glossiness while exhibiting less bleeding of the images with time.

The coating liquid for the ink-receiving layer, which, for example, contains vapor-phase silica, polyvinyl alcohol (PVA), boric acid, a cationic resin, a nonionic or an amphoteric surfactant, and a high boiling point organic solvent, as the first liquid for the coating process can be prepared as follows. Details of each component constituting the first liquid, and the preferable range thereof are as described previously.

The first liquid can be prepared by: adding vapor-phase silica to water; further adding the cationic resin and dispersing with a high pressure homogenizer or sand mill; adding boric acid to the mixture; adding an aqueous PVA solution (so that, for example, the amount of PVA accounts for ⅓ by mass of vapor-phase silica); and adding the nonionic or amphoteric surfactant and high boiling point organic solvent and stirring. The coating liquid obtained is a uniform sol, and a coating layer may be formed by applying the liquid onto the support by the coating method described below, and a porous ink receiving layer having a three-dimensional net structure obtained. PVA may be prevented from partial gelation by adding the PVA after diluting the boric acid as described above.

Aqueous dispersed liquid having an average particle diameter of 10 to 300 nm can be prepared by grain-refining the first liquid (the coating liquid for the ink receiving layer) using a disperser. Known various dispersers such as a high speed rotating disperser, a medium stirring type disperser (a ball mill and a sand mill or the like), an ultrasonic disperser, a colloid mill disperser or a high pressure disperser can be used as a disperser which is used for obtaining the water dispersion liquid. However, the medium stirring type disperser, the colloid mill disperser and the high pressure disperser are preferable in view of dispersing efficiently agglomerate-like fine particles formed.

In the invention, the first liquid is preferably an acid solution. The pH of the first liquid is preferably 6.0 or less, more preferably 5.0 or less, and most preferably 4.0 or less. The pH can be adjusted by properly selecting the kind and the added amounts of the cationic resin. An organic acid or an inorganic acid may also be added for adjusting the pH of the first liquid. When the pH of the first liquid is 6.0 or less, the cross-linking reaction of the water-soluble resin due to the cross-linking agent (particularly, boron compound) can be more sufficiently suppressed in the first liquid.

For example, the first liquid (the coating liquid for an ink receiving layer) in the coating can be coated by a known coating method using an extrusion die coater, an air doctor coater, a bread coater, a rod coater, a knife coater, a squeeze coater, a reverse roll coater, a bar coater or the like.

The second liquid (the basic liquid) can be applied in the hardening after the coating liquid (the first liquid) for the ink receiving layer is coated. The second liquid is preferably applied before the coating layer exhibits a decreasing rate of drying. That is, the coating layer is preferably produced by applying the second liquid while the coating layer exhibits a constant rate of drying after the first liquid is coated.

The second liquid may contain a cross-linking agent and other mordant components if necessary. The hardening of the layer can be accelerated by using the second liquid that is an alkaline solution. The second liquid is preferably adjusted to a pH of 7.1 or more, more preferably a pH of 7.5 or more, and particularly preferably a pH of 7.9 or more. When the pH is too close to acidic range, the cross-linking reaction of the water-soluble polymer included in the first liquid is not performed sufficiently by the cross-linking agent, and thereby bronzing and the defect due to the crack or the like may be caused in the ink receiving layer.

For example, the second liquid can be prepared by adding a metal compound (for example, 1 to 5% relative to the amount of the ion-exchange water), a basic compound (for example, 1 to 5% relative to the amount of the ion-exchange water), and, if necessary, para-toluene sulfonate (for example, 0.5 to 3% relative to the amount of the ion-exchange water) to the ion-exchange water, and by stirring the resultant mixture sufficiently. The term "%" in each composition refers to solid mass.

Water, an organic solvent or the mixed solvent thereof can be used as the solvent used for preparing each liquid. Examples of organic solvents which can be used for coating include alcohols such as methanol, ethanol, n-propanol, i-propanol or methoxy propanol, ketones such as acetone or methyl ethyl ketone, tetrahydrofuran, acetonitrile, ethyl acetate, and toluene.

"Before the coating layer exhibits a decreasing rate of drying" in the hardening step usually refers to the period of a few minutes immediately after coating the coating liquid for the ink receiving layer. During the period, the coating layer exhibits a constant rate of drying, during which the contained amount of the solvent (dispersing medium) in the coating layer decreases in proportion to time. For example, the time exhibiting the "constant rate of drying" is described in Chemical Engineering Handbook (pp. 707-712, Maruzen Co., Ltd., Oct. 25, 1980).

As described above, after coating the first liquid, the coating layer is dried until the coating layer formed of the first liquid exhibits a decreasing rate of drying. In general, the coating layer is dried for 0.5 to 10 minutes (preferably, for 0.5 to 5 minutes) at a temperature in a range of 40 to 180° C. (preferably, at a temperature in a range of 50 to 120° C.). The above-mentioned range is usually suitable though the drying time naturally depends on the coating amount.

Examples of methods for applying before the coating layer exhibits a decreasing rate of drying include (1) a method for coating the second liquid further on the coating layer, (2) a method for spraying by a spray or the like, and (3) a method for soaking a support on which the coating layer is formed in the second liquid.

In the method (1), for example, a known coating method such as those using a curtain flow coater, an extrusion die coater, an air doctor coater, a bread coater, a rod coater, a knife coater, a squeeze coater, a reverse roll coater, or a bar coater can be used as a coating method for coating the second liquid. It is preferable to use a method in which a coater does not directly contact with the coating layer which has already been formed, and examples thereof include methods using the extrusion die coater, the curtain flow coater or the bar coater.

After the second liquid is applied, the coating layer is generally heated at a temperature in a range of 40 to 180° C. for 0.5 to 30 minutes, is dried and is hardened. The coating layer is preferably heated at a temperature in a range of 40 to 150° C. for 1 to 20 minutes.

The coating process and the hardening process can be simultaneously carried out. That is, the second liquid (basic solution) is suitably applied at the same time of coating the first liquid (coating liquid for the ink receiving layer). In this case, the first liquid and the second liquid are simultaneously applied on the support (multilayer coating) such that the first liquid is contact with the support, dried and hardened.

For example, the simultaneous coating (laminating layer coating) can be performed by the coating method which uses the extrusion die coater and the curtain flow coater. The coating layer formed is then dried. In this case, in general, the coating layer is dried by heating at 15 to 150° C. for 0.5 to 10 minutes, and more preferably at 40 to 100° C. for 0.5 to 5 minutes.

When the simultaneous coating (multilayer coating) is performed by the extrusion die coater, two kinds of coating liquids which are simultaneously exhaled are formed to a laminated form near the discharge port of the extrusion die coater before the liquids move on the support, and thus formed laminate is multilayer-coated on the support while maintaining the laminated form. When two coating liquids which are formed to a laminated form before coating are moved to the support, a cross-linking reaction is easily caused in the interface of two liquids. Therefore, two liquids discharged tend to be mixed so as to have increase viscosity near the discharge port of the extrusion die coater, and thereby a hindrance may be caused in the coating operation. Therefore, when a simultaneous coating is conducted as described above, a barrier layer liquid (an intermediate layer liquid) is preferably interposed between the first liquid and the second liquid so as to conduct a simultaneous coating of three layers.

The barrier layer liquid can be selected without specific limitation. Examples of the barrier layer liquid include solution which contains a small amount of the water-soluble resin and water. The water-soluble resin is used for viscosity improver or the like in consideration of coating property. Examples of the water-soluble resins include polymers such as a cellulose resin (such as hydroxypropyl methylcellulose, methyl cellulose hydroxy ethyl methyl cellulose or the like), polyvinylpyrrolidone or gelatin. The barrier layer liquid can contain a mordant.

The surface smoothness, glossiness degree, transparency and coating film strength of the ink receiving layer can be improved by performing a calendar treatment that includes transporting the coated material between roll nips under heating and pressurizing by using a super-calendar and a gross calendar or the like after forming the ink receiving layer on the support. However, it is necessary to set the condition which suppresses a reduction of the void ratio since the calendar treatment may cause the reduction of the void ratio, which may cause reduction in the ink absorption performance.

The temperature of the roll is preferably in a range of 30 to 150° C., and more preferably in a range of 40 to 100° C. when performing the calendar treatment. The line pressure between the rolls is preferably in a range of 50 to 400 kg/cm, and more preferably in a range of 100 to 200 kg/cm when performing the calendar treatment.

It is necessary that the layer thickness of the ink receiving layer is determined in relation to the void ratio of the layer since the layer thickness of the ink receiving layer should have an absorption volume that is enough to absorb all droplets in case of the ink jet recording. When the amount of ink is 8 nL/mm$^2$ and the void ratio of the layer is 60%, the layer thickness of about 15 μm or more is needed. Therefore, the layer thickness of the ink receiving layer is preferably in a range of 10 to 50 μm in case of the ink jet recording.

The pore size of the ink receiving layer preferably has a median diameter of 0.005 to 0.030 μm, and more preferably 0.01 to 0.025 μm. The void ratio and the pore median diameter can be measured by using a mercury porosimeter (trade name: BORESIZER 9320-PC2, manufactured by Shimadzu Corporation).

The ink receiving layer preferably has excellent transparency. When the ink receiving layer is formed on a transparent film having a haze value of 0%, an indicating value of the transparency of the ink receiving layer is shown by a haze value thereof, and the haze value of the ink receiving layer is preferably in a range of 3 to 40%, more preferably in a range of 5 to 40%, and particularly preferably in a range of 10 to 40%. The haze value can be measured with a haze meter (trade name: HGM-2DP, manufactured by Suga Test Instrument Co., Ltd.).

Hereinafter, a second embodiment of the ink jet recording medium of the present invention is described in detail.

The second embodiment of the ink jet recording medium has a center line average roughness average Ra of the surface of the support measured with a 2.5 mm measuring length and 0.8 mm cut-off value as defined in ISO 4287 (1997) is in a range of 0.3 μm or more but less than 1.0 μm, and an image clarity of the surface of the ink receiving layer as defined in ISO 10216 (1992) is in a range of 2 to 40%.

The present invention is able to provide the ink jet recording medium that provides a ink jet print having a sharpness and a sense of depth and is excellent in recordings of images of people or the like by setting the range of the center line average roughness average Ra of the surface of the support measured with a 2.5 mm measuring length and 0.8 mm cut-off value to be in the range of 0.3 μm or more but less than 1.0 μm.

The center line average roughness average Ra of the surface of the support is preferably in a range of 0.35 μm or more but less than 1.0 μm, and is more preferably in a range of 0.4 μm or more but less than 1.0 μm, in view of suppressing excessive glossiness of an image surface and providing natural and high-grade printings.

While the method for restricting Ra on the surface of the support to within the range as described above includes methods (1) and (2), the method is not restricted thereto:

(1) a method of providing the ink-receiving layer on a support subjected to an embossing treatment, and (2) a method of coating a base paper with a molten polyolefin resin followed by pressing by a molding roll.

Specifically, the surface Ra may be controlled in method (1) by subjecting the surface of the ink-receiving layer to treatment with an embossing calender.

The surface Ra may be controlled in method (2) by forming various emboss patterns by pressing an cooling roller having a regular roughness on a surface thereof onto the surface of a coated molten polyolefin resin on the base paper while cooling.

While the method for controlling Ra is not particularly restricted, the above method (2) is economically preferable.

The support of the second embodiment of the ink jet recording medium is similar to that of the first embodiment of the ink jet recording medium, and preferable examples thereof are also similar to those of the first embodiment, except that the surface Ra of the support is adjusted as described above.

An image clarity of the surface of the ink receiving layer of the second embodiment of the ink jet recording medium as defined in ISO 10216 (1992) is similar to that of the first embodiment of the ink jet recording medium, and preferable range thereof is also similar to that of the first embodiment.

Further, other constituents of the second embodiment of the ink jet recording medium is similar to those of the first embodiment of the ink jet recording medium, and preferable examples thereof are also similar to those of the first embodiment.

EXAMPLES

Hereinafter, the present invention will be described by way of the following examples. However, the invention should not be limited by the examples. A sheet for ink jet recording is prepared as one example of the ink jet recording medium in the Examples. In the Examples, the term "part" and the term "%" represent part by mass and % by mass, respectively, as long as there is no specific indication.

Example 1

50 parts of LBKP derived from acacia and 50 parts of LBKP derived from aspen are refined to 300 ml of Canadian Freeness by using a disc refiner so as to prepare a pulp slurry.

Next, to the thus obtained pulp slurry, 1.3% of cationic starch (trade name: CATO 304L, produced by Nippon NSC, Ltd.), 0.15% of anionic polyacrylamide (trade name: Polyakron ST-13, produced by SEIKO PMC CORPORATION), 0.29% of alkylketenedimer (trade name: Sizepine K, produced by Arakawa chemical Industries, Ltd.), 0.29% of epoxidized amide behenate, and 0.32% of polyamide polyamine epichlorohydrin (trade name: Arafix 100, produced by Arakawa Chemical Industries, Ltd.) were added. 0.12% of a defoaming agent was further added to the resultant mixture.

The pulp slurry prepared as described above was formed into paper using a Fourdrinier paper machine, and base paper (base sheet) with a basis weight of 174 g/m$^2$, a thickness of 170 μm and a water content of 7.5% was manufactured passing through a dryer, size press and machine calender.

The concentration of the size press liquid was adjusted to 5%, and the liquid was applied on both faces of the paper with an amount of coating of 1.25/m$^2$ after drying. The size press liquid comprises 2 parts of polyvinyl alcohol (trade name: KL-118, manufactured by Kuraray Co.) and 1 part of sodium chloride.

After corona discharge treatment on the wire surface (back face) of the base paper, high density polyethylene (density: 0.96 g/cm$^3$) was coated at a thickness to become 29 g/m$^2$ on the paper using a melt extruder to form a thermoplastic resin layer comprising a mat surface (the surface having the thermoplastic resin layer is referred to as the "back face" hereinafter).

Subsequently, the top face was subjected to a corona discharge treatment, and low density polyethylene, which was adjusted to contain 20% of anatase-type titanium oxide, 0.3% of ultramarine and 0.08% of brightener with a density of 0.93 g/cm$^3$, was coated at 29 g/m$^2$. A chill roll used was an iron roll having microscopically roughened surface by sandblasting after chromium plating on the surface. The chill roll was adjusted by changing sandblasting treatment by adjusting the kind of the particles and treatment time, to obtain a support with a CLA surface roughness average Ra of 0.75 μm.

Preparation of Ink-Receiving Layer Coating Liquid A (First Liquid)

A dispersion solution was prepared by mixing the compositions below (1) vapor-phase silica, (2) ion-exchange water, (3) a dispersing agent (trade name: SHALLOL DC-902P, manufactured by Dai-Ichi Kogyo Seiyaku Co., Ltd.) and (4) zirconium acetate (trade name: ZIRCOZOL ZA-30, manufactured by Daiichi Kigenso Kagakukogyo Co., Ltd.), and by dispersing the mixture to a median diameter of 0.109 μm at a frequency of 20 KHz using a ultrasonic dispersing machine UH600S (trade name, manufactured by SMT Co.). The dispersion solution was heated at 45° C. and kept for 20 hours. Thereafter, the below described (5) boric acid, (6) polyvinyl alcohol solution, (7) Super Flex 600B, (8) polyoxyethylene lauryl ether and (9) ethanol were added at 30° C. to prepare the ink-receiving layer coating liquid A (first liquid).

Formulation of Ink-Receiving Layer Coating Liquid A

| | | |
|---|---|---|
| (1) | Vapor-phase silica microparticles (inorganic particles) (trade name: AEROSIL 300SF75, manufactured by Nippon Aerosil Co., Ltd.) | 10.0 parts |
| (2) | Ion-exchanged water | 64.8 parts |
| (3) | Dispersing agent (SHALLOL DC-902P, described above) | 0.87 parts |
| (4) | Zirconium acetate (ZIRCOZOL ZA-30, described above) | 0.54 parts |
| (5) | Boric acid (cross-linking agent) | 0.37 parts |
| (6) | Polyvinyl alcohol (water-soluble resin) solution | 29.4 parts |
| | Formulation of the solution (6): | |
| | Polyvinyl alcohol (trade name: PVA 235, manufactured by Kuraray Co., Ltd.) | 2.03 parts |
| | Polyoxyethylenelaurylether (surfactant) | 0.03 parts |
| | EDTA-DM (manufactured by Sanko Co., Ltd.) | 0.06 parts |
| | Diethyleneglycol monobutylether (trade name: BUTYCENOL 20P, manufactured by Kyowa Hakko Co., Ltd.) | 0.68 parts |
| | Ion-exchanged water | 26.6 parts |
| (7) | Urethane resin (trade name: SUPERFLEX 600B, manufactured by Dai-Ichi Kogyo Seiyaku Co., Ltd.) | 1.24 parts |
| (8) | Polyoxyethylenelaurylether (surfactant) (trade name: EMULGEN 109, 10% aqueous solution, manufactured by Kao Co., Ltd.) | 0.49 parts |
| (9) | Ethanol | 2.49 parts |

Preparation of Ink Jet Recording Sheet

After applying a corona discharge treatment to the front of the support, coating liquid A (first liquid) was flowed onto the front surface so that the coating amount was 173 ml/m$^2$, and an aqueous solution of polyaluminum chloride (trade name: Alfine 83, manufactured by Taimei Chemicals Co. Ltd.) diluted five-fold was coated thereon in-line at a coating amount of 10.8 ml/m$^2$. The coating layer was dried with a hot-air dryer at 80° C. (air flow rate of 3 to 8 m/sec) until the concentration of the solid fraction of the coating layer was 20%. This coating layer exhibited a constant rate of drying during this time. The support was then, before the coating layer exhibited a decreasing rate of drying, immersed for 3 seconds in the basic liquid B (the second liquid) with the below composition to allow the liquid to adhere onto the coating layer at an amount of 13 g/m$^2$, followed by drying at 80° C. for 10 minutes (hardening process). The ink jet recording sheet in Example 1 having an ink receiving layer with a thickness of 32 μm after drying was thus prepared.

Formulation of Basic Liquid B

| | | |
|---|---|---|
| (1) | Boric acid (cross-linking agent) | 0.65 parts |
| (2) | Ammonium zirconium carbonate (trade name: ZIRCOZOL AC-7, manufactured by Daiichi Kigenso Kagakukogyo Co., Ltd.) | 2.5 parts |
| (3) | Ammonium carbonate (reagent grade, manufactured by Kanto Chemical Co., Inc.) | 3.5 parts |
| (4) | Ion-exchanged water | 63.3 parts |
| (5) | Polyoxyethylenelaurylether (surfactant) (trade name: EMULGEN 109, 10% aqueous solution, manufactured by Kao Co., Ltd.) | 30.0 parts |

Comparative Example 1

An ink jet recording sheet of Comparative example 1 was prepared in the same manner as Example 1, except that a support having a support having a CLA surface roughness average Ra of 1.64 μm was used in place of the above-described support.

Example 2

An ink jet recording sheet of Example 2 was prepared in the same manner as Example 1, except that a beads mill (trade name: KD-P, manufactured by Shinmaru Enterprises Co.) was used in place of the ultrasonic dispersing machine so as to disperse a mixture to a median diameter of 0.153 μm.

Example 3

An ink jet recording sheet of Example 3 was prepared in the same manner as Example 1, except that a support having a support having a CLA surface roughness average Ra of 0.32 μm, that is obtained by adjusting a chill roll through changing a condition of sandblasting treatment by adjusting the kind of the particles and treatment time, was used in place of the above-described support.

Example 4

An ink jet recording sheet of Example 4 was prepared in the same manner as Example 2, except that a beads mill was used in place of the ultrasonic dispersing machine so as to disperse a mixture to a median diameter of 0.192 μm.

Example 5

An ink jet recording sheet of Example 4 was prepared in the same manner as Example 2, except that the amount of the anatase-type titanium oxide in the resin coating layer on the front surface of the base paper was changed from 20% to 5%.

Comparative Example 2

An ink jet recording sheet of Comparative example 2 was prepared in the same manner as Example 2, except that a support having a support having a CLA surface roughness average Ra of 0.23 μm was used in place of the above-described support.

Comparative Example 3

An ink jet recording sheet of Comparative example 3 was prepared in the same manner as Example 2, except that a support having a support having a CLA surface roughness average Ra of 0.82 μm was used in place of the above-described support.

Comparative Example 4

An ink jet recording sheet of Comparative example 4 was prepared in the same manner as Example 2, except that in place of the beads mill, a high speed rotation wet colloid mill (trade name: CLEARMIX, manufactured by M Technique Co., Ltd.) was used with a condition of 1,000 μm for 10 minutes so as to disperse a mixture to a median diameter of 0.243 μm.

Evaluation

The following evaluation tests were performed for each of the ink jet recording sheets obtained in Examples 1 to 5 and Comparative Examples 1 to 4. The results of the evaluation are shown in Table 1 below.

(1) Evaluation of Surface Roughness

The CLA surface roughness average (Ra) of the surfaces of the ink-receiving layer and support were measured with a measuring length of 2.5 mm and a cut-off value of 0.8 mm as prescribed in ISO 4287 (1997) using a TENCOR P-11 (trade name, manufactured by KLA Tencor Co.).

(2) Evaluation of Image Clarity (Glossiness)

Image clarity (C value percent) of the surface of the ink receiving layer was measured using light at a reflection angle of 60° with an optical comb width of 2.9 mm using a touch-panel image clarity meter (trade name: ICM-1T, manufactured by Suga Test Instruments Co. Ltd.) in accordance with ISO 10216 (1992).

(3) Evaluation of Haze of the Ink Receiving Layer

After subjecting a transparent PET base with a thickness of 100 μm to corona discharge treatment, an ink receiving layer was formed using each coating solution in the Examples and Comparative Examples, and haze of the layer was measured with a haze computer (trade name: HGM-2DP, manufactured by Suga Test Instruments Co. Ltd.).

(4) Evaluation of Specular Reflectivity of Support

Total reflectivity and diffuse reflectivity relative to light having a wavelength of 440 mm were measured using a color analyzer 607 (trade name, manufactured by Hitachi Co.), and specular reflectivity (%) was determined by subtracting diffuse reflectivity from total reflectivity. The larger the specular reflectivity the brighter and sharper the image.

(5) Evaluation of Sharpness

A sine wave chart was printed on the ink jet recording sheet, and a modulation transfer function (MTF) was determined using a densitometer and compared at 5 cycle/mm. A value closer to 1 corresponds to a better sharpness.

Evaluation of Image Print Quality of Portraits

A photographic image of a portrait was printed on each ink jet recording sheet in the Examples and Comparative Examples using an ink jet recorder (trade name: G-800, manufactured by Seiko Epson Co.). The image quality was visually evaluated as follows.

Image Quality Evaluation Aspect:

<1> brightness of pupils in eyes;

<2> clearness of hair;

<3> shininess of forehead; and

<4> sense of dept

Evaluation Criteria

A: very good,

B: good,

C: slightly poor, and

D: poor

| | Support | | Ink receiving layer | | | | Image quality of portrait | | | |
|---|---|---|---|---|---|---|---|---|---|---|
| | Surface roughness (Ra) (μm) | Specular reflectivity (%) | Surface roughness (Ra) (μm) | Image clarity (%) | Haze value | Sharpness | Brightness of pupils | Clearness of hair | Shininess of forehead | Sense of depth |
| Example 1 | 0.75 | 6.80 | 0.71 | 13.20 | 18.30 | 0.56 | A | A | B | A |
| Example 2 | 0.75 | 6.80 | 0.72 | 11.80 | 24.80 | 0.52 | A-B | A-B | B | A-B |
| Example 3 | 0.40 | 6.80 | 0.32 | 20.40 | 18.30 | 0.54 | A-B | A | B-C | A |
| Example 4 | 0.75 | 6.80 | 0.74 | 2.40 | 28.90 | 0.42 | B | B | B | B |
| Example 5 | 0.75 | 1.40 | 0.72 | 8.00 | 24.80 | 0.32 | B-C | B-C | B | B-C |
| Comparative Example 1 | 1.64 | 5.90 | 1.31 | 8.30 | 18.30 | 0.44 | D | C | C | C |
| Comparative Example 2 | 0.23 | 6.80 | 0.16 | 63.10 | 24.80 | 0.52 | C | C | D | B-C |
| Comparative Example 3 | 1.05 | 6.80 | 0.82 | 9.80 | 24.80 | 0.50 | D | C | C | C |

-continued

| | Support | | Ink receiving layer | | | | Image quality of portrait | | | |
|---|---|---|---|---|---|---|---|---|---|---|
| | Surface roughness (Ra) (μm) | Specular reflectivity (%) | Surface roughness (Ra) (μm) | Image clarity (%) | Haze value | Sharpness | Brightness of pupils | Clearness of hair | Shininess of forehead | Sense of depth |
| Comparative Example 4 | 0.75 | 6.80 | 0.78 | 1.80 | 32.40 | 0.36 | C-D | C-D | C | D |

Table 1 clearly shows that clearness (sharpness) and image quality were excellent in the ink jet recording sheet of Examples 1 to 5, while the image quality was quite poor in the ink jet recording sheet of Comparative Examples 1 to 4, although sharpness (clarity of the image) was comparative to that of the examples.

The invention claimed is:

1. An ink jet recording medium comprising a support and an ink receiving layer provided on at least one surface of the support, wherein a center line average roughness average Ra of a surface of the ink-receiving layer, measured in accordance with ISO 4287 (1997) with a 2.5 mm measuring length and 0.8 mm cut-off value, is in a range of 0.3 μm or more but less than 0.8 μm, and an image clarity of the surface of the ink receiving layer, measured in accordance with ISO 10216 (1992), is in a range of 2 to 40%.

2. The ink jet recording medium according to claim 1, wherein a specular reflectivity of the support relative to light having a wavelength of 440 nm is in a range of 2 to 10%.

3. The ink jet recording medium according to claim 1, wherein a haze value of the ink receiving layer is in a range of 3 to 40%.

4. The ink jet recording medium according to claim 2, wherein a haze value of the ink receiving layer is in a range of 3 to 40%.

5. The ink jet recording medium according to claim 1, wherein the ink receiving layer comprises:

at least one kind of water-soluble resin selected from the group consisting of polyvinyl alcohol resins, cellulose resins, resins having ether bonding, resins having a carbamoyl group, resins having a carboxyl group, and gelatin; and at least one kind of microparticle selected from the group consisting of silica fine particles, colloidal silica, alumina fine particles, and pseudo boehmite.

6. An ink jet recording medium comprising a support and an ink receiving layer provided on at least one surface of the support, wherein a center line average roughness average Ra of the surface of the support, measured in accordance with ISO 4287 (1997) with a 2.5 mm measuring length and 0.8 mm cut-off value, is in a range of 0.3 μm or more but less than 1.0 μm, and an image clarity of a surface of the ink receiving layer, measured in accordance with ISO 10216 (1992), is in a range of 2 to 40%.

7. The ink jet recording medium according to claim 6, wherein a specular reflectivity of the support relative to light having a wavelength of 440 nm is in a range of 2 to 10%.

8. The ink jet recording medium according to claim 6, wherein a haze value of the ink receiving layer is in a range of 3 to 40%.

9. The ink jet recording medium according to claim 7, wherein a haze value of the ink receiving layer is in a range of 3 to 40%.

10. The ink jet recording medium according to claim 6, wherein the ink receiving layer comprises:

at least one kind of water-soluble resin selected from the group consisting of polyvinyl alcohol resins, cellulose resins, resins having ether bonding, resins having a carbamoyl group, resins having a carboxyl group, and gelatin; and at least one kind of microparticle selected from the group consisting of silica fine particles, colloidal silica, alumina fine particles, and pseudo boehmite.

* * * * *